US005749160A

United States Patent [19]

Dexter et al.

[11] Patent Number: 5,749,160

[45] Date of Patent: May 12, 1998

[54] MULTI-ZONE METHOD FOR CONTROLLING VOC AND NOX EMISSIONS IN A FLATLINE CONVEYOR WAFER DRYING SYSTEM

[75] Inventors: Jeffrey L. Dexter; David C. Siemers; Larry J. Head; Donald E. Miller, all of Evansville, Ind.; Bruce Grebe, Bemidji, Minn.; William Nowack, Twin Lakes, Wis.; Daniel Wolff, Norcross, Ga.

[73] Assignee: George Koch Sons, Inc., Evansville, Ind.

[21] Appl. No.: 660,954

[22] Filed: Jun. 10, 1996

Related U.S. Application Data

[63] Continuation-in-part of Ser. No. 388,075, Feb. 14, 1995, Pat. No. 5,524,361.

[51] Int. Cl.[6] ..... F26B 3/00

[52] U.S. Cl. ..... 34/502; 34/509; 34/500

[58] Field of Search ..... 34/502, 500, 509, 34/210, 218, 76, 501

[56] References Cited

U.S. PATENT DOCUMENTS

| | | | |
|---|---|---|---|
| 1,751,552 | 3/1930 | Kehoe . | |
| 3,209,467 | 10/1965 | Taylor, Jr. | 34/155 |
| 3,999,306 | 12/1976 | Koch, II et al. | 34/225 |
| 4,263,721 | 4/1981 | Danford | 34/35 |
| 4,287,671 | 9/1981 | Koch, II | 34/23 |
| 4,753,020 | 6/1988 | Brunner | 34/196 |
| 4,831,746 | 5/1989 | Kim et al. | 34/23 |
| 5,215,670 | 6/1993 | Girovich | 210/770 |
| 5,341,580 | 8/1994 | Teal | 34/446 |
| 5,524,361 | 6/1996 | Dexter et al. | 34/502 |

*Primary Examiner*—Henry A. Bennett
*Assistant Examiner*—Dinnatia Doster
*Attorney, Agent, or Firm*—David H. Semmes

[57] ABSTRACT

Environmental enhancement by controlling volatile organic compound (VOC) and $NO_x$ emissions in a flatline wafer drying system. The method is characterized by advancing the wafers of the type used in manufacture of oriented strand board (OSB) on a flatline conveyor embodying a plurality of dryer zones. Particularly, heating the dryer zones in successive lower temperatures in the range 500° F. to 200° F. by flowing heated air upwardly through the flatline wafer drying conveyor; removing VOC-rich exhaust air from a primary dryer zone while flowing heated air upwardly therein and removing VOC-rich exhaust air from a secondary dryer zone while flowing heated air from therein.

7 Claims, 3 Drawing Sheets

MULTI-ZONE METHOD FOR CONTROLLING VOC AND NOX EMISSIONS IN A FLATLINE CONVEYOR WAFER DRYING SYSTEM

CROSS-REFERENCE TO RELATED APPLICATIONS

A Continuation-in-Part of FLATLINE METHOD OF DRYING WAFERS (Ser. No. 08/388,075), filed Feb. 14, 1995, now U.S. Pat. No. 5,524,361.

In U.S. Pat. No. 5,524,361 wood wafers of the type used in the manufacture of oriented strand board (OSB) are dried by advancing the wood wafer above a planar surface; heated air is forced upwardly through spaced apart holes defined in the planar surface and through the random array of advancing wafers; then the heated air and accumulated moisture is evacuated from above the advancing wood wafers.

The present application is directed to a method of controlling VOC and $NO_x$ emissions in such a flatline wafer drying conveyor system.

BACKGROUND OF THE INVENTION

1. Field of the Invention

Drying of particulate material, such as wood chips (wafers/strands), bark or the like, for manufacture of oriented strand board (OSB).

2. Description of the Prior Art

Pertinent prior patents and publications: being supplied in an Information Disclosure Statement.

Rotary dryers have been utilized to dry wood strands. Applicants' flatline method used in the manufacture of oriented strand board (OSB) eliminates two critical negatives inherent in all rotary drying systems. These are: mechanical and thermal stresses imposed on strands with the subsequent loss of material, and the excessive release of VOCs as a result of drying temperatures in excess of 800° F.

This conventional release of VOC emissions requires the use of additional control equipment with a capital cost and an ongoing utility cost estimated to be unacceptable. The use of add-on control devices was regarded within the oriented strand board (OSB) industry as a necessity in light of provisions set forth in the 1990 Clean Air Act.

SUMMARY OF THE INVENTION

In applicants' MULTI-ZONE METHOD FOR CONTROLLING VOC AND $NO_X$ EMISSIONS IN A FLATLINE CONVEYOR WAFER DRYING SYSTEM, portions of the exhausted air stream from the drying process can be delivered to a waste-wood burner (primary heat source) resulting in lower emissions of pollutants to the Environment.

Water and VOCs are released from the wood product in the form of vapor during the drying process and are contained within the air mass circulated through the individual dryer.

As the moisture concentration approaches saturation (Dew Point), the ability of the air to accept additional moisture and hold it in suspension is diminished. This is also true for VOCs. VOCs have a wide range of evaporation temperatures; some VOCs evaporate at lower temperatures than water and some at higher temperatures than water. The VOCs contained within different wood species vary as do the temperatures at which they are released. The environment within individual dryer sections is controlled to optimize the VOC removal for these variations in wood species. By controlling the temperature of the circulated air and the moisture concentration of the air within a given dryer section, it is possible to vary both the VOC and water concentrations of the air stream. Controlling the exhaust air stream from these controlled environments allows for the removal of VOCs at optimum locations within the dryer.

According to the present method, the moisture and VOCs are extracted from the system by means of exhausting variable portions of the vapor-laden air mass at various locations within each dryer zone and replacing this exhausted air with equivalent amounts of fresh air which contain less moisture. When this process is controlled, the moisture content of the air within the individual zones can be maintained at an optimum level to enhance the uniform drying of wafers and to exercise some control over where, within the dryer, the moisture and VOCs are released.

Reduction of VOC emissions into the atmosphere is possible with the utilization of a waste wood burner as the primary heat source and pollution control device. Supplying portions of VOC and moisture laden exhausted air from various dryer exhaust ports to the primary, secondary and tertiary combustion air ports of the wood burner allows the VOCs to be incinerated during the combustion process. Along with the VOCs, water is introduced into the combustion process and reacts differently, but can effect some benefits if introduced in a controlled manner. There is a maximum amount of water that can be introduced to the waste-wood burner during the combustion process. Likewise, there are limits to the amount of water that can be introduced to various locations in the burner. The combustion process takes place in stages within the burner and requires regulation of the fuel and introduction of combustion air at various locations and flow rates to optimize combustion.

Conventionally, nitrogen is introduced into the combustion process via two (2) sources, the combustion air and the organic fuel (waste wood). In order to achieve complete combustion, excess air is introduced to ensure that adequate oxygen is present during the combustion process. The introduction of oxygen results in higher temperatures as the combustion process accelerates. Nitrous Oxides ($NO_x$) are chemical compounds formed during high temperature combustion. During high temperature combustion $NO_x$ and other chemical species become dissociated with the combustion process. The dissociation and equilibriums are exceedingly complex, but generally higher temperatures tend to increase the dissociation while lower temperatures tend to reduce the dissociation of these chemical species. Introduction of water into the combusiton air stream can serve to reduce the combustion temperature; thus, reduce the dissociation of $NO_x$.

Conversely, the introduction of excessive moisture into the combustion air stream can cause a quenching of the combustion flame which results in the formation of alcohols, aldehydes, formic acids, high order acids and carbon monoxide, as well as carbon dixoide and water vapor. Quenching is the result of excessive cooling of the combusiton flame which, in turn, results in incomplete combustion. This suports the premise that the introduction of moisture into the combustion process must be accomplished in a controlled manner.

The exhausted air from the wafer dryers contains VOCs and water vapor. These components are natural by-products of the drying process. The novelty or innovativeness results from the introduction of these components into the combustion process in a controlled manner in order to achieve incineration of the VOCs and benefit from the presence of moisture in the combustion air as a result of the drying process. It is not necessary to equip the burner with an elaborate means of introducing water vapor into the combustion air. Due to the controlled environments within the dryer and the ability to exhaust variable volumes of air from various locations within the dryer, this water vapor is already present in the exhausted air stream. The ability to control the environment within the dryer allows the moisture and VOCS to be removed at controlled rates and supplied to the combustion process in such a manner as to incinerate the VOCs and assist in the control of the combustion process to reduce the dissociation of $NO_x$, thereby reducing the emissions of VOCs and NOx into the atmosphere.

DESCRIPTION OF THE PREFERRED EMBODIMENTS

Figure 1:
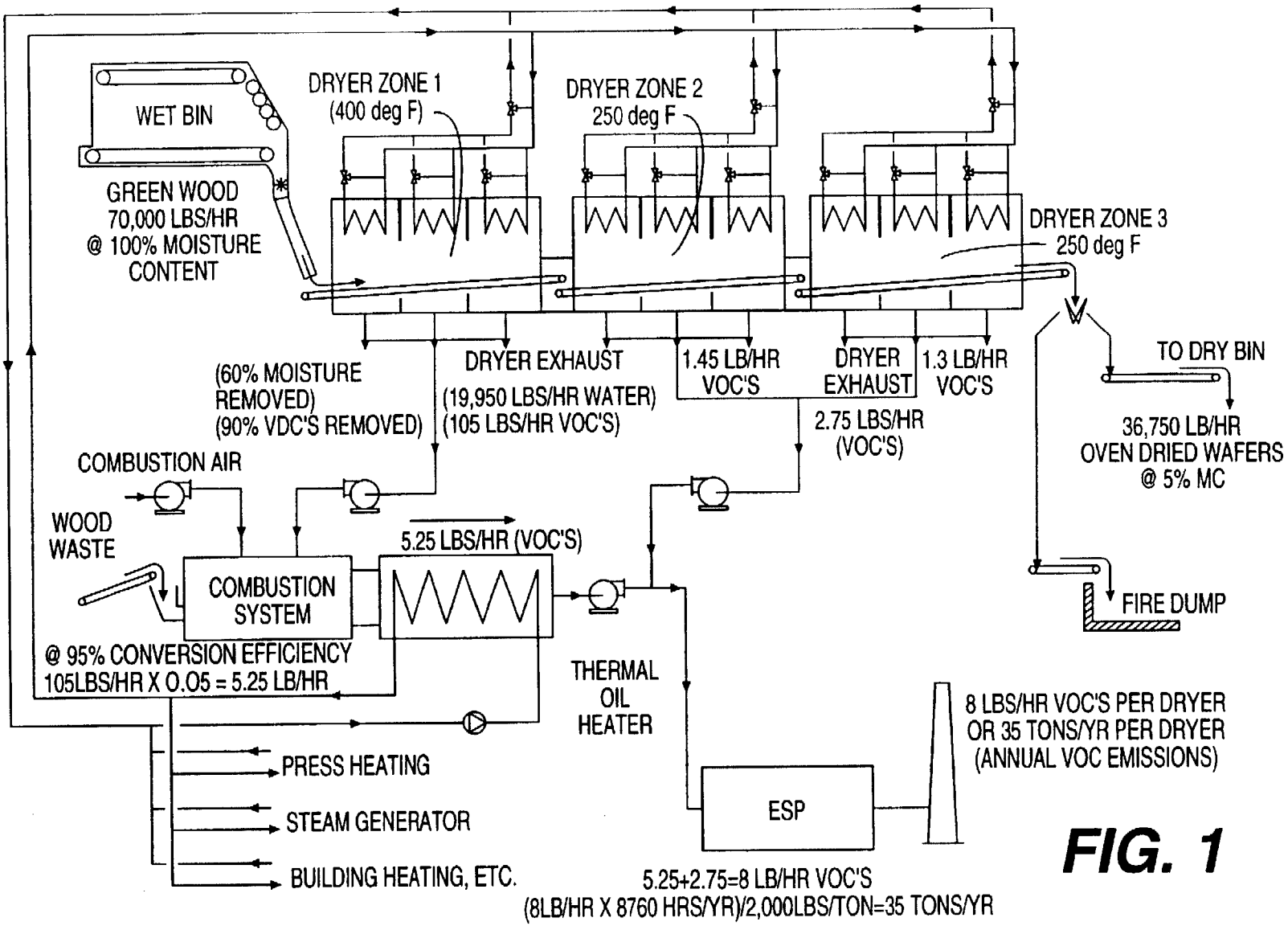
FIG. 1 is a schematic of a flatline wafer drying system entitled "Flow Diagram for Southern Yellow Pine" and embodying three dryer zones of the type which may be utilized according to the present invention.
Figure 2:
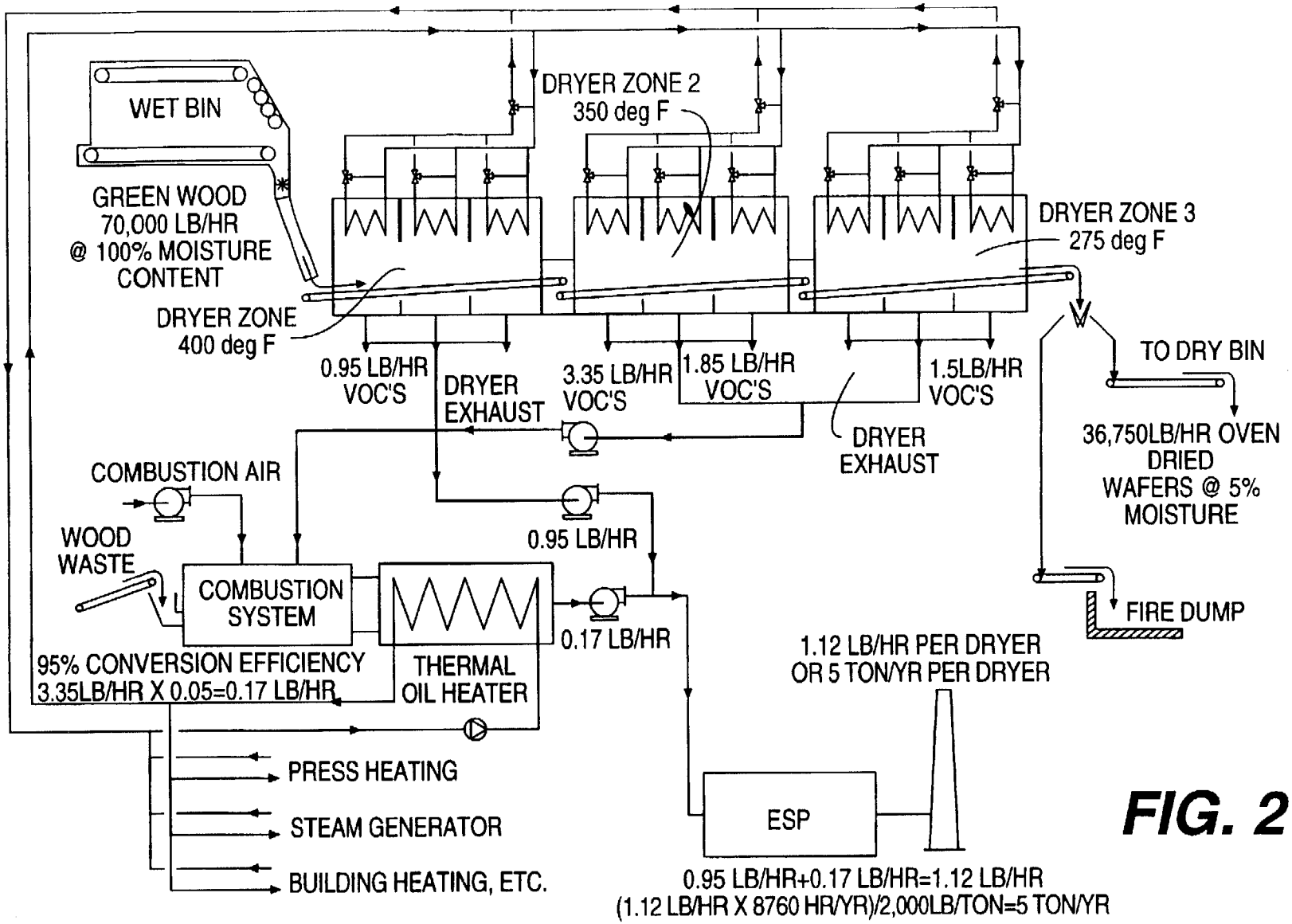
FIG. 2 is a similar schematic entitled: "Flow Diagram for Aspen".

One of the most important distinctions between rotary dryers and Applicants' flatline technology is the way in which material is moved through the system. In a rotary system, strands are tumbled and pushed along with hot gases through the cylindrical drying apparatus. Compaction and mechanical damage are common. In addition, gases are typically 800°–1800° F.—a temperature which easily auto-ignites small wood strands and fines. The typical result is a minimum of a 3% loss of wood resources during drying, and a significant fire hazard.

In contrast, Applicants' proposed Flatline Dryer System positively transports wood strands through the dryer without compaction, and without temperature-stressing the material. In this system, a 2 to 12" high mat of wood strands is transported on a steel flatwire belt which rides on a perforated ¼" thick steel slider. The supply air plenum is located under the perforated steel plate.

Supply air is heated by smooth surface, thermal oil heat exchangers, which are heated with thermal oil from the customer's energy system. Heated air is directed into the supply plenum and forced upwardly through the perforated openings and the 2–12" high mat of wood strands, resulting in moisture removal. In addition, strands are never exposed to temperatures above 500° F.; thus, the OSB producer enjoys the advantage of virtually 100% wood yield through the drying process.

Applicants' system anticipates yields of 35,000 lbs. of oven dried (OD) strands per hour. This is a capacity which is practical and cost-efficient for most OSB producers. The overall length of the three-zone dryer, including in-feed, out-feed and intermittent conveyors is 220 ft.

Extensive testing shows that a three-zone system is most effective for strand processing. Each zone is 60 ft. in length and each of these three zones is further divided into three 20-ft. sections. Each section is served by twin recirculation fans and individually controlled thermal oil heat exchangers. With this system configuration, it is possible to operate with as many as nine independent set point temperatures. This is desirable when multiple wood species are processed together, and when strands have a broad range of moisture content.

Applicants' system is simple and straightforward in its design. It uses standard, commercially available components, and has been engineered so that the majority of maintenance activity can be performed without system shutdown. Applicant's flatline system is also distinctive in that it is floor level and allows easy access for routine maintenance.

The 5–6 minute dwell time common with rotary drying is widely regarded as the benchmark for strand drying when the specification is for an exit moisture content of 2–4% m.c. Rotary systems achieve this goal in 5–6 minutes by starting with air which is heated to between 800° and 1800° F. Applicants' goal was to develop a drying system which could dry strands in 5–6 minutes at temperatures below 400° F.

During its earliest tests, air was blown from above and below the strands, and the flatline prototype achieved a 3% moisture content following an 8.5 minute cycle. By redesigning the system to supply airflow exclusively from below the conveyor, and by introducing mild mechanical agitation, the strands became fluidized, compression was eliminated, and the six-minute goal was achieved. Additional system enhancements included the chance from a balanced weave belt to a flat wire belt, using a smaller opening (with higher static pressure) in the plenum for maximum uniformity in air distribution, and the installation of twin picker rolls which agitate the mat as the strands passed. This became a second means to insure consistent exposure of the strands to heated air and thus insure uniform drying.

Worker safety, insurance costs, the risk of fire-related production stoppage, and the ability to maximize wood yields all depend on the way in which strands are managed within the dryer. Rotary systems have no effective way of isolating dust, fines and small wood particles, and problems with auto-ignition are well-documented. A primary advantage for the flatline system is that wood fines are captured before they have an opportunity to accumulate in the dryer. This was achieved through a design feature integral to the transport conveyor which collects fines continuously and removes them from the dryer. In addition, the design is free of horizontal surfaces and corners where fines and dust can accumulate.

Applicants' flatline system is engineered for predictable, programmed performance with little operator involvement. It is protected by safety interlocks on primary access doors which prevent unauthorized opening and by a comprehensive fire detection/suppression system.

Tests on aspen strands indicate the majority of VOCs are released during zones two and three. This is due to characteristics of the VOCs in the wood, which release at a higher temperature later in the drying cycle. Thus, exhausted airstreams from zones two and three are directed to the energy system as combustion air; exhaust from the initial zone is directed to the multi-clone and ESP.

Applicants' flatline system also benefits the user in that a wider variety of species can be processed. In regions where aspen or Southern yellow pine become less available, or have become more costly, producers can supplement using birch. Birch, which curls at elevated temperatures, can be processed very successfully in the lower heat of Applicants' system.

The constituents emitted as VOCs that OSB producers must be concerned with include tars and resins, fatty acids and terpenes. The organics are liberated at elevated temperatures; the volume of VOCs that must be dealt with is a direct function of how high drying temperatures are, and for how long. Additionally, OSB mills must control the emission of particulate.

Of the tests conducted using Applicants' system, those involving Southern yellow pine—a species comparatively rich in VOCs—were most significant. Tests showed that operating the first dryer zone at 400° F. removed 60% of the moisture and more than 90% of the total VOCs that would be liberated by the drying process. By maintaining dryer zones two and three at just 225° F., drying would be completed with very little additional VOC release. When the timing of the VOC release becomes controllable, what had been a troublesome emission can be turned into a powerful resource. Specifically with Applicants' flatline system, VOC-rich exhaust air from zone one is used as combustion air in the user's energy system. The energy system uses hog fuel—scrap wood from debarking—in a burner which creates high temperature exhaust gas which is passed through the radiant and convection section of the thermal oil system. These high temperature gases elevate the temperature of the thermal oil, which is pumped to heat exchangers in the flatline dryer. The heat exchangers provide the energy to maintain temperature set points of the dryer operation. The customer's thermal oil system is also used to heat the press used to manufacture panels or strandboard following strand drying and the application of resin. Thermal oil systems are also used for facility climate control, and for heating log ponds.

Exhaust air from zones two and three is directed to multi-clones, and then to electrostatic precipitators. These devices are typically necessary regardless of what type of dryer is used.

Applicants' flatline system is managed by integrated controls which use standard PLC/I-O interfaces. The processors are coupled with a computer which runs a model-based software supervisory package. An advanced, easy to use graphic interface serves as the operations control. The system provides anticipatory control by monitoring variables such as moisture content and the weight of incoming strands and making appropriate adjustments. The system also responds to throughput demands from equipment downstream; if, for example, the dry bin level is changing, dryer throughputs are modified accordingly. The model also performs complete self and sensor diagnostics. Backing up the model is a series of basic control functions integral to the PLC which will continue system operation at various default values. The control system performs a broad range of high level manage reporting. It offers easy compatibility with SPC schemes and can make an important contribution to ISO 9000 programs.

OSB producers have calculated the costs of a traditional rotary dryer with add-on control devices vs. Applicants' flatline dryer. Assuming a 35,000 lbs/hr. O.D. production rate, the overcapital cost comparison is competitive. What distinguishes the two alternatives is first, with the rotary dryer, the on-going cost of the natural gas for the RTO, and maintenance on the unit. A second cost difference using the flatline dryer is the 3% higher wood yields provided by the flatline system. If a producer purchases $15 million of wood annually, a 3% savings equates to $450,000 in wood resource savings. A third cost advantage is the ability of the flatline system to accommodate longer strands, as well as wider range of wood species. Longer strands—6" or longer, as opposed to 3.5" strands—means the wood will be cut fewer times, resulting in fewer fractured pieces and less wood fines. Manifestly, this results in improved wood utilization in the manufacturing process.

Figure 3:
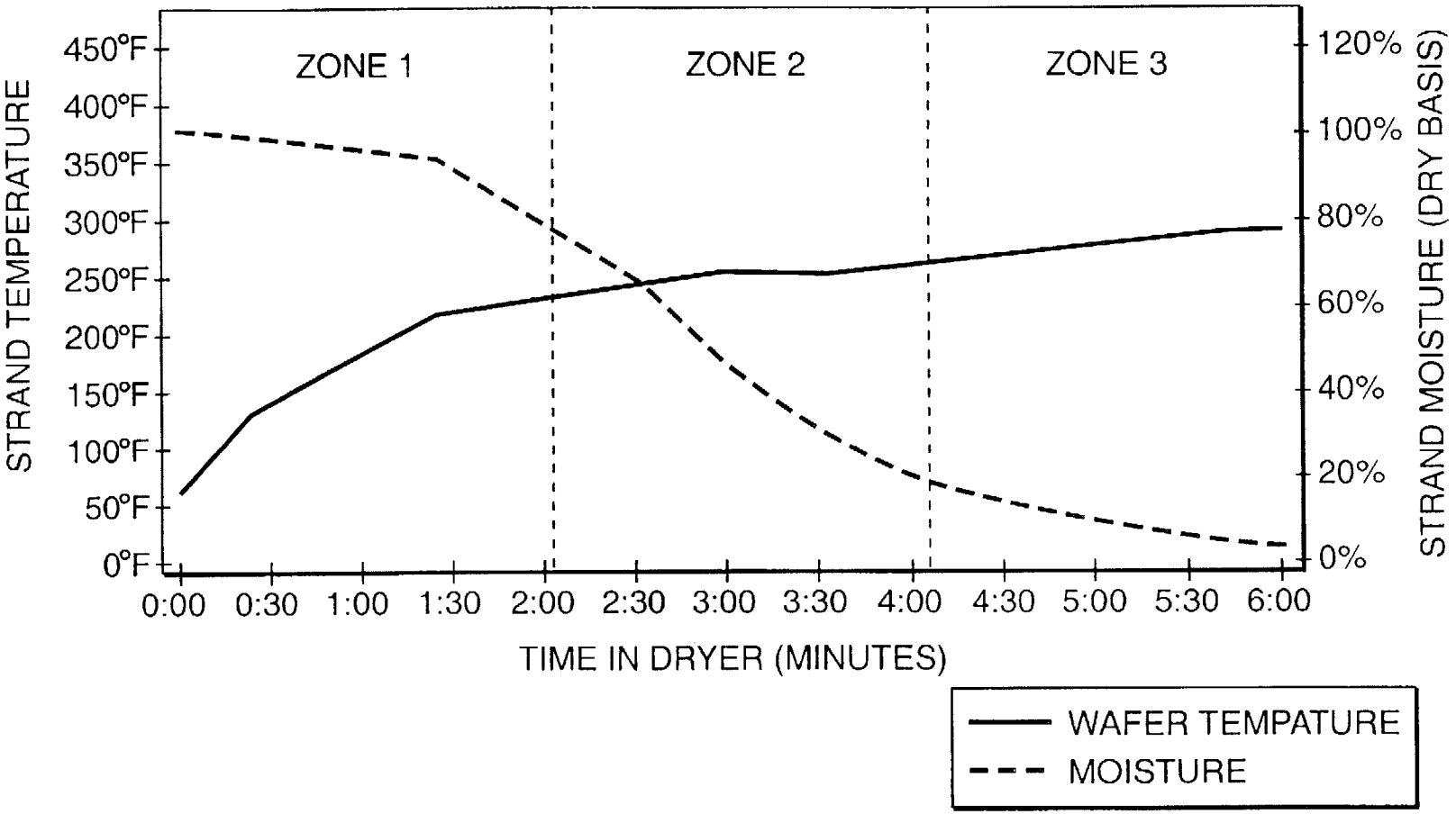
FIG. 3 is a strand temperature and moisture profile graph.

Applicants' flatline dryer benefits the OSB producer in important ways. It delivers greater yields, facilitates greater flexibility in processing and material feed and offers a dramatic alternative to the cost and complexity of RTO devices. Because the flatline dryer operates at lower heat and more closely controls wood fines, it also offers an important safety advantage over traditional rotary devices. See FIG. 3 for strand temperature and moisture profile during low temperature flatline drying.

I TESTING

Testing was performed for particulate, nitrous oxides ($NO_x$), carbon monoxide (CO), total hydrocarbons (THC), formaldehyde and phenol emissions.

The particulate matter was sampled according to US EPA Reference Method 5. The stack gas moisture, velocity and volumetric flow rates were also determined during this isokinetic sampling procedure. This data enabled conversion of flue gas pollutant concentrations to emission data values in pounds per hour (lb/hr).

The formaldehyde was sampled according to the EPA Method 0011/8315 procedure entitled "Sampling for Aldehydes and Ketone Emissions from Stationary Sources". The stack gas moisture, velocity and volumetric flow rates were also determined during this sampling procedure. This data enabled conversion of all flue gas pollutant concentrations to emission data values in pounds per hour (lb/hr).

The sampling for gaseous compound concentrations occurred simultaneously with the formaldehyde testing. The volumetric flow determination obtained pursuant to Method 0011 test was used in converting the gaseous concentrations from parts per million (ppm) to pounds per hour (lb/hr).

The gaseous compounds were collected and analyzed by test methods that utilize "real-time" continuous emission monitor (CEM) instrumentation. This technology provides data with a high degree of reliability on-site. Reference Methods 3A, 7E, 10 and 25A were employed for the analysis of oxygen and carbon dioxide, $NO_x$, CO and THC, respectively.

These testing procedures set forth a sampling strategy to continuously extract sample gas from the source. This sample stream is routed to individual CEMs for analysis of the various targeted pollutants and diluent gases. The test results are based on the average value of one-minute averages generated by the CEM instrument data acquisition during the test periods. Three (3) sampling periods were performed in which the gaseous concentrations were continuously monitored for the listed target compounds.

The phenol was sampled according to the EPA Method TO-8 procedure entitled "Method for the Determination of Phenol and Methylphenois (Cresols) in Ambient Air Using High Performance Liquid Chromatography". The purpose of the performance test was to determine if the emissions of the targeted gaseous pollutants from this source are equal to or below the allowable emission limitation established for the appropriate regulatory authorities.

II. TEST RESULTS

Tables A through C report the results of the particulate, $NO_x$, CO, THC, formaldehyde and phenol testing done on this source. The $NO_x$ values are reported as nitrogen dioxide, the THC is reported as methane.

Table A tabulates the particulate test results for each test run and are shown in concentration, grains per dry standard cubic foot (gr/dscf) and in emission values of pounds per hour (lb/hr).

TABLE A

Particulate Test Summary
April 26, 1996

| Run | Time | gr/dsct | lbhr | Isokinetic, % |
|---|---|---|---|---|
| 1 | 08:50–10:05 | 0.0037 | 2.57 | 103.7 |
| 2 | 10:35–11:40 | 0.0040 | 2.81 | 101.7 |
| 3 | 12:15–13:20 | 0.0060 | 4.23 | 103.0 |
| | Average: | 0.0046 | 3.20 | |
| | Allowable: | | 11.20 | |

The $NO_x$, CO and THC results are tabulated for each test run and are shown in concentration, parts per million (ppm), dry basis, on Table B-1 and in emission values of pounds per hour (lb/hr) on Table B-2.

TABLE B-1

$NO_x$, CO and THC Concentration Summary
April 25, 1996

| Run | Time | O2, % | CO2, % | Concentration, ppm | | |
|---|---|---|---|---|---|---|
| | | | | NOx | CO | THC(dry) |
| 1 | 13:39–14:39 | 14.5 | 6.1 | 65.11 | 25.32 | 144.77 |
| 2 | 14:54–15:54 | 14.4 | 6.1 | 68.17 | 28.62 | 145.38 |
| 3 | 17:31–18:31 | 14.3 | 6.2 | 66.57 | 18.21 | 208.10 |
| | Average: | 14.4 | 6.1 | 66.62 | 24.05 | 166.08 |

TABLE B-2

$NO_x$, CO and THC Emission Summary

| Run | Emission, lb/hr | | |
|---|---|---|---|
| | NOx | CO | THC |
| 1 | 34.47 | 8.16 | 26.67 |
| 2 | 36.13 | 9.24 | 26.82 |
| 3 | 35.38 | 5.89 | 38.48 |
| Average: | 35.33 | 7.76 | 30.66 |
| Allowable: | 50.70 | 32.00 | 30.90 |

Table C tabulates the formaldehyde and phenol test results for each test run and are shown in concentration, grains per dry standard cubic foot (gr/dscf) and in emission values of pounds per hour (lb/hr).

TABLE C

Formaldehyde and Phenol Emission Summary

| Run | Formaldehyde | | | Phenol* | | |
|---|---|---|---|---|---|---|
| | Time | gr/dscf | lb/hr | Time | gr/dscf | lb/hr |
| 1 | 13:35–14:35 | 0.0001 | 0.06 | 14.45–15.45 | BDL | BDL |
| 2 | 15:00–16:00 | 0.0002 | 0.13 | 16:10–17:10 | BDL | BDL |
| 3 | 17:40–18:40 | 0.0001 | 0.06 | 17:30–18:30 | BDL | BDL |
| | Average: | 0.0001 | 0.08 | Average: | BDL | BDL |
| | Allowable: | | 0.30 | Allowable: | | 0.02 |

*BDL = below detection limit of .2 mg

During the third run of the total hydrocarbon testing, the process had problems with plugging of the fuel line to the burner. The plant notified the testing crew of the problem and testing was stopped. When the test resumed, the hydrocarbon readings were higher than the previous two runs. The higher readings may be attributed to the time needed for the process to stabilize. The average of all three runs is still below the allowable 30.9 lb/hr.

Benefits of enhanced routing of the exhausted moisture and VOCs to a waste wood burner for incineration include:

I. Each dryer section (comprised of two opposing heater houses) can be equiped with a multitude of exhaust ports. These exhaust ports can be located at a variety of locations within the section to allow for optimum removal of moisture and VOCs.

II. Exhaust ports can be directed singularly or as a plurality to the atmosphere, single or multiple auxiliary pollution control devices (such as Regenerative Thermal Oxidizers, Bio-Filters, Electrostatic Precipitators, etc.), and/or to one or more locations (primary, secondary or tertiary) at the primary waste wood burner as determined to enable a significant reduction of VOCs emitted to the atmosphere.

III. Moisture introduced into the burner reduces the formation and emission of Nitrous Oxides ($NO_x$) largely due to a reduction in flame temperature. The reduction of $NO_x$ emissions wil be offset by an in increase in Carbon monoxide (CO) emissions. This must be monitored and optimized in order to comply with emissions allowances established and permitted by the EPA.

IV. VOCs introduced into the burner become an auxiliary source of fuel and contribute to the energy released by the primary fuel (waste wood). The greater the VOC content of the exhaust air introduced into the burner, the less primary fuel (waste wood) is needed.

V. By regulating the environment within individual sections and zones, it is possible to exhaust VOCs and/or moisture from optimum locations (singular or a plurality of locations) and direct the exhaust stream to the most effective post-dryer pollution control device. When the vast majority of the emissions from a given zone or section is water, it is logical to send the exhaust stream directly to the atmosphere. By controlling the section/zone environments, it is possible to increase the concentration of VOCs released within given locations and route the exhaust from such sections/zones to the waste wood burner for incineration.

VI. Different, wood species release different combinations of VOCs and at different concentrations and conditions. Depending on the wood species and the controlled environment within given sections/zones, it is possible to release large concentrations of water initially in the drying process and route the exhaust from early stages to the atmosphere because of low concentrations of VOCs in the exhausted air streams. Conversely, with some wood species, it appears that much higher concentrations of VOCs can be released in the early stages of drying and the exhaust from these stages can be routed to the waste wood burner for incinertion. Due to the wide variation in wood species and the differences in the release of VOCs, it is necessary to have a multitude of locations to exhaust from.

We claim:

1. Multi-zone method for controlling VOC and $NO_x$ emissions in a flatline conveyor wafer drying system embodying a plurality of dryer zones comprising:

a. advancing wafers in random array on a flat wire conveyor belt having laterally restrictive openings with the wood wafers being supported upon the conveyor and the conveyor being supported on a planar surface, such that wafers are substantially suspended without contact above the planar surface;

b. forcing heated air upwardly through spaced-apart holes of varying diameter and distribution defined in the planar surface, then forcing heated air above the planar surface, while laterally shielding heated air above the planar surface, then forcing heated air through the random array of advancing wafers, wherein the size and distribution of holes within the planar surface are a control of distributing heated air;

c. heating the dryer zones in successively lower temperatures in the range 500° F. to 200° F. by flowing heating air upwardly through the flatline conveyor;

d. removing VOC-rich exhaust air from a primary dryer zone while flowing heated air upwardly therein, and;

e. removing VOC-rich exhaust air from a secondary dryer zone while flowing heated air upwardly therein.

2. Multi-zone method for controlling VOC and $NO_x$ emission in a flatline conveyor wafer drying system, as in claim 1, wherein the flatline wafer dryer conveyor is advanced through primary, secondary and tertiary dryer zones and including removing VOC exhaust from the tertiary dryer zone while flowing heated air upwardly therein.

3. Multi-zone method for controlling VOC and $NO_x$ emission in a flatline conveyor wafer drying system as in claim 2, wherein said heating is by a thermal oil heat exchanger.

4. Multi-zone method for controlling VOC and $NO_x$ emission in a flatline conveyor wafer drying system as in claim 1, wherein VOC-rich exhaust from at least one dryer zone is used as combustion air in a complementary energy system.

5. Multi-zone method for controlling VOC and $NO_x$ emission in a flatline conveyor wafer drying system as in claim 1, wherein VOC-rich exhaust removed from said primary dryer zone is used as combustion air in a hog fuel burner system.

6. Multi-zone method for controlling VOC and $NO_x$ emission in a flatline conveyor wafer drying system as in claim 2, including flowing exhaust from at least one dryer zone through an electrostatic precipitator.

7. Multi-zone method for controlling VOC and $NO_x$ emission in a flatline conveyor wafer drying system as in claim 2, including measuring moisture content and weight of wafers and varying temperature and volume of flowing said heated air in said primary, secondary and tertiary dryer zones as a control of VOC and $NO_x$ emissions.

* * * * *